US006378173B1

(12) United States Patent
Ho et al.

(10) Patent No.: US 6,378,173 B1
(45) Date of Patent: Apr. 30, 2002

(54) HINGE FOR AN ENCLOSURE

(75) Inventors: Dennis K. Ho, Coquitlam; William Fenton, Surrey, both of (CA)

(73) Assignee: Silent Witness Enterprises, Ltd. (CA)

( * ) Notice: Subject to any disclaimer, the term of this patent is extended or adjusted under 35 U.S.C. 154(b) by 0 days.

(21) Appl. No.: 09/520,814

(22) Filed: Mar. 8, 2000

(51) Int. Cl.[7] ..... E05D 7/00
(52) U.S. Cl. ..... 16/373; 16/366; 220/241
(58) Field of Search ..... 16/373, 366, 327; 174/66; 220/241, 3.8, 324; 126/25 R

(56) References Cited

U.S. PATENT DOCUMENTS 2,442,873 A * 6/1948 Graham ..... 16/373
2,670,872 A * 3/1954 Olesky ..... 16/373
2,770,387 A * 11/1956 Loween ..... 220/817
2,792,245 A * 5/1957 Dasher et al. ..... 220/324
3,692,012 A * 9/1972 Wiggins ..... 126/25 R
4,134,516 A * 1/1979 Sullo ..... 220/3.8
4,390,002 A * 6/1983 Daily. III ..... 16/373
5,152,596 A * 10/1992 Raleigh ..... 16/373
6,146,159 A * 11/2000 Brunker ..... 174/66

* cited by examiner

*Primary Examiner*—Lynne H. Browne
*Assistant Examiner*—Doug Hutton
(74) *Attorney, Agent, or Firm*—Hall, Priddy, Myers & Vande Sande

(57) ABSTRACT

A hinge apparatus consisting of a wire hinge, hinge bracket and cover bracket to provide a means for permitting the easy removal of a cover of a protective enclosure without its complete disengagement from the body of the enclosure. The hinge apparatus maintains the attachment of the cover to the main body of the protective enclosure without hindering access to the internal components within the enclosure.

7 Claims, 7 Drawing Sheets

HINGE FOR AN ENCLOSURE

FIELD OF THE INVENTION

The invention herein disclosed relates to a hinge for an enclosure for facilitating the servicing of devices having two or more parts and which are mounted in difficult to access locations. Specifically, the invention is a hinge apparatus for multi-part devices such as video surveillance camera enclosures.

BACKGROUND OF THE INVENTION

There are devices which have two or more separable parts that are normally mounted in difficult to access areas and which require in situ servicing. The first step in servicing such devices is to remove the cover, usually by removing a set of cover screws that hold the cover to a body of the device. If the workman is on a ladder or platform high above the ground or working through an access hole or port, dropping of the screws and possibly the cover once it is detached is problematic. For example, conventional video surveillance units include a video camera that is placed within a protective enclosure. The protective enclosure is normally designed to prevent tampering with an enclosed camera unit.

Various types of protective enclosures have been designed for different installation configurations. In general, such configurations include mounting the unit on a vertical or horizontal planar surface such as a wall or ceiling, in a corner position at the intersection of two walls and a ceiling, or as a self-enclosed unit. Typically the protective enclosures can be disassembled into two separate components, namely, a cover, which is normally attached via tamper-proof screws, and the main body of the enclosure.

Access to the camera unit within the enclosure is accomplished by loosening and removing the tamper-proof screws and detaching and removing the cover from the main body of the enclosure. The protective enclosure is often designed so that it easily falls off as soon as the screws are removed. While this process is easily accomplished when the unit is being manufactured, difficulty arises when disassembling units that are in situ.

Video surveillance cameras are typically installed in places that are difficult to access, such as many feet off of the ground on the side of a building, or in the corner of the high lobby area of an office tower. Access to the units typically occurs during either installation or maintenance by a workman who is standing atop a long ladder with a screwdriver and screws in his hands. Frequently this poses a problem when the cover disengages, as the workman must hold onto the screw driver and the screws while he attempts to catch the cover as it disengages. Thus, a solution is required to alleviate this awkward and dangerous situation.

It is the object of the present invention to provide a solution to the aforementioned problem by providing an apparatus which facilitates the removal of a cover plate of a device having a cover plate and a body without complete detachment from the body of the cover plate so as to permit easy access to the components within the protective enclosure.

SUMMARY OF THE INVENTION

According to the invention there is provided a hinge apparatus for an enclosure having a body and a cover removably affixable to the body. The apparatus includes a hinge bracket affixed to the body and a cover bracket affixed to the cover. A hinge is attached at one end to the hinge bracket and at another end to the cover bracket. The hinge is moveable so as to expose and provide access to an interior of the body.

The hinge assembly permits easy removal of the cover without its complete disengagement from the body. The wire hinge, hinge bracket and cover bracket may be adapted in both size and shape to the various types and styles of enclosures such as, for example, protective enclosures manufactured for video surveillance cameras. The apparatus disclosed herein provides a simple, element and cost-effective solution to the problem of a protective enclosure that has a cover that completely detaches from its associated body.

The hinge may consist of a length of wire that conforms to the shape and size of the intention perimeter of the body so that the hinge does not interfere with the placement and closing of the cover onto the body, nor with any components within the body.

Preferably, the wire has sufficient tensile strength to form an open-ended spring having open ends bent back sharply on themselves wherein the open ends can be pressed together and inserted into the hinge bracket and constrained thereby to pivotal movement.

The wire may have a cover bracket insertion portion compressible so as to be insertable into the cover bracket.

The hinge bracket may be affixed to the body and further include a first hinge element and a second hinge element operative to receive ends of said hinge and to hold the ends in compression.

The cover bracket may be affixed to the cover and have an open side into which the third hinge element is slidably insertable. The third hinge element may be held in the cover bracket by compression, and thereby provide an attachment of the cover to the body.

In another aspect of the invention there is provided a protective enclosure for a video surveillance camera, having a body and a cover, comprising an interconnecting assembly interconnecting the body and the cover and permitting the cover to be removed and extended away from the body so as to expose an interior of the body.

BRIEF DESCRIPTION OF THE DRAWINGS

Further features and advantages will be apparent from the following detailed description, given by way of example, of a preferred embodiment taken in conjunction with the accompanying drawings, wherein.

DESCRIPTION OF THE PREFERRED EMBODIMENT

Figure 1A:
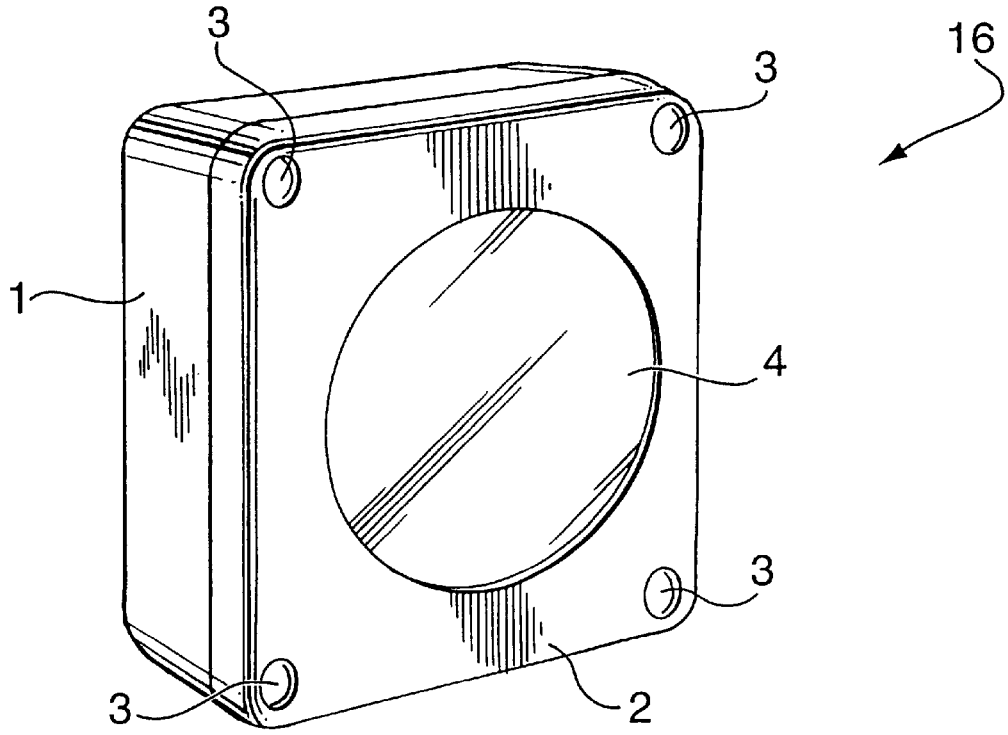
FIG. 1a PRIOR ART
FIG. 1*a,* 1*b,* 1*c* and 1*d* are perspective views of various types of protective closures commonly found in video surveillance installations.

In the following descriptions, like reference numbers in the various Figures refer to the like parts. Referring to FIGS. 1*a,* 1*b,* 1*c* and 1*d* there are shown perspective views of various types of protective closures commonly found in video surveillance installations. The common components for each enclosure are shown on each figure. These components are: the main body 1; the cover 2; one or more tamper-proof screws 3; and the lens cover 4, which collectively form the protective enclosure 16.

Figure 1B:
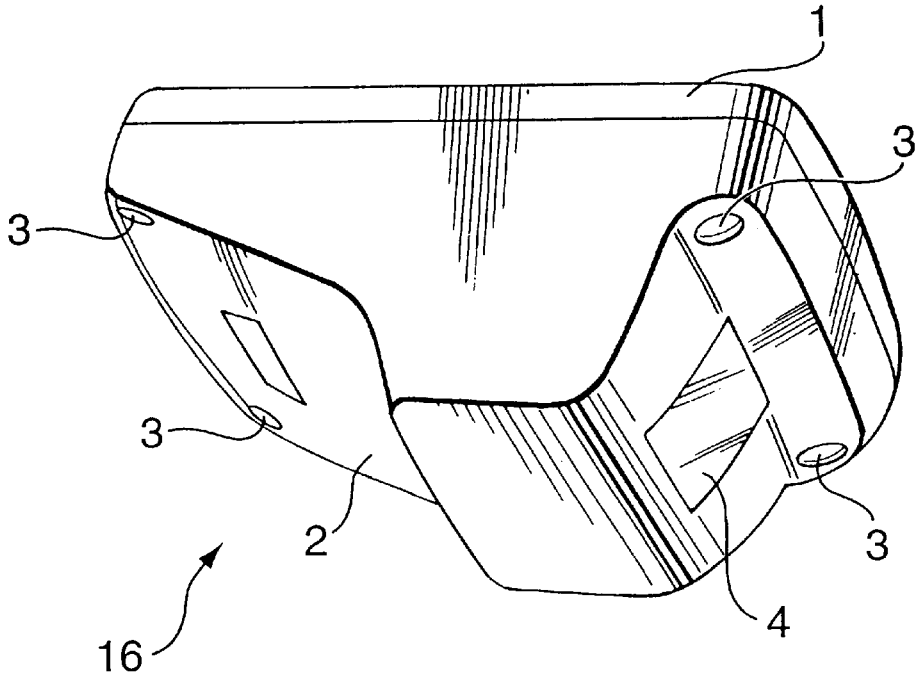
FIG. 1b PRIOR ART
Figure 1C:
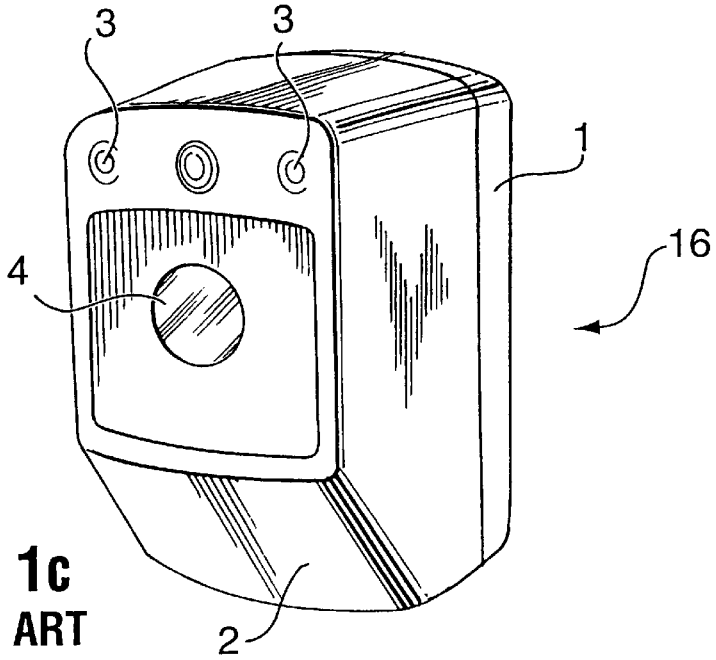
FIG. 1c PRIOR ART
Figure 1D:
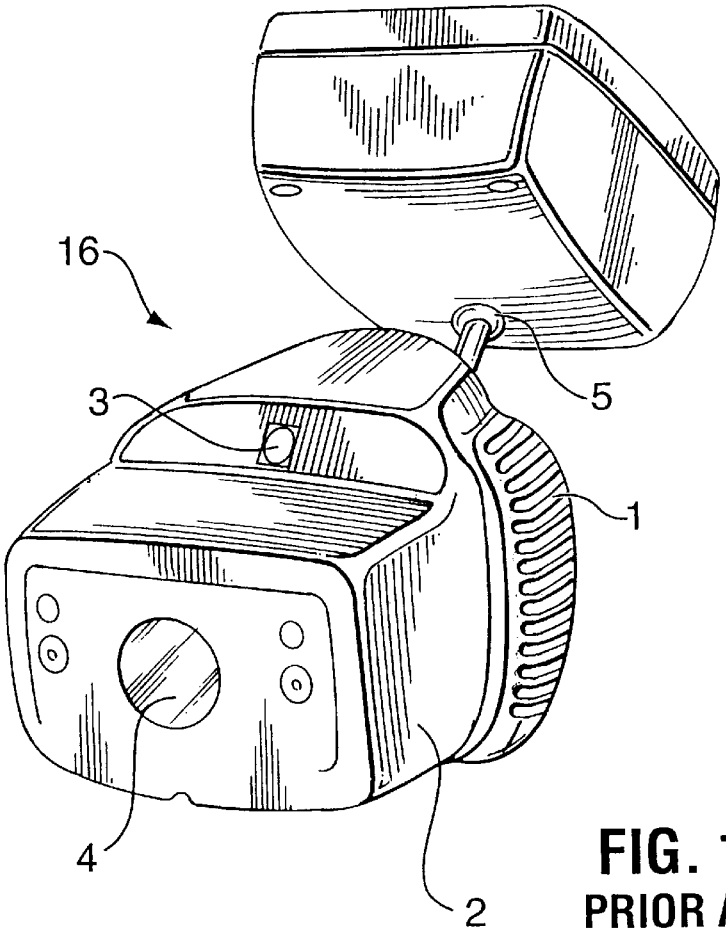
FIG. 1d PRIOR ART

FIG. 1*a* is a protective enclosure having a square shape. This type of protective enclosure 16 is designed for mounting on a planar surface, such as a wall or ceiling. FIG. 1*b* is a protective enclosure having a wedge shape. The wedge-shaped protective enclosure is also designed for mounting on a planar surface, such as a wall or ceiling. FIG. 1*c* is a protective enclosure 16 having a rectangular shape. This type of protective enclosure 16 is also designed for mounting on a planar surface, such as a wall or ceiling. It may also be mounted using a swivel mount, which then allows it to be mounted on a ceiling or wall and to perform pan, tilt and rotate adjustments. FIG. 1*d* is a self-enclosed unit having a protective enclosure 16 with a rectangular shape. The unit of FIG. 1*d* can also be attached to a swivel mount 5, which allows it to be mounted on planar surfaces, such as a wall or ceiling. Like FIG. 1*c,* the swivel mount 5 allows this video camera unit to perform pan, tilt and rotate adjustments.

Access to the camera unit within the protective enclosures shown in FIG. 1*a,* 1*b,* 1*c* and 1*d* is accomplished by loosening and removing the tamper-proof screws 3, and detaching and removing the cover 2 from the main body 1 of the enclosure. The cover 2 is often designed so that it easily falls off as soon as the screws 3 are removed. While removal of the cover 2 is easily accomplished when the unit is being manufactured, difficulty arises when disassembling units in situ during installation or maintenance. To make the video surveillance cameras unobtrusive and difficult to tamper with, they are typically installed in difficult to access sites, such as up the side of a building or in the corner of the high lobby area of an office tower. Typically these sites are several feet off the ground. This poses a significant problem when the cover disengages and must be caught quickly before it falls to the ground or to a difficult to access area. Since many of the cover plates such as those shown in FIG. 1*b,* 1*c* and 1*d* also contain expensive electrical circuitry and camera components, substantial harm is often done to the units if they are dropped.

Figure 2A:
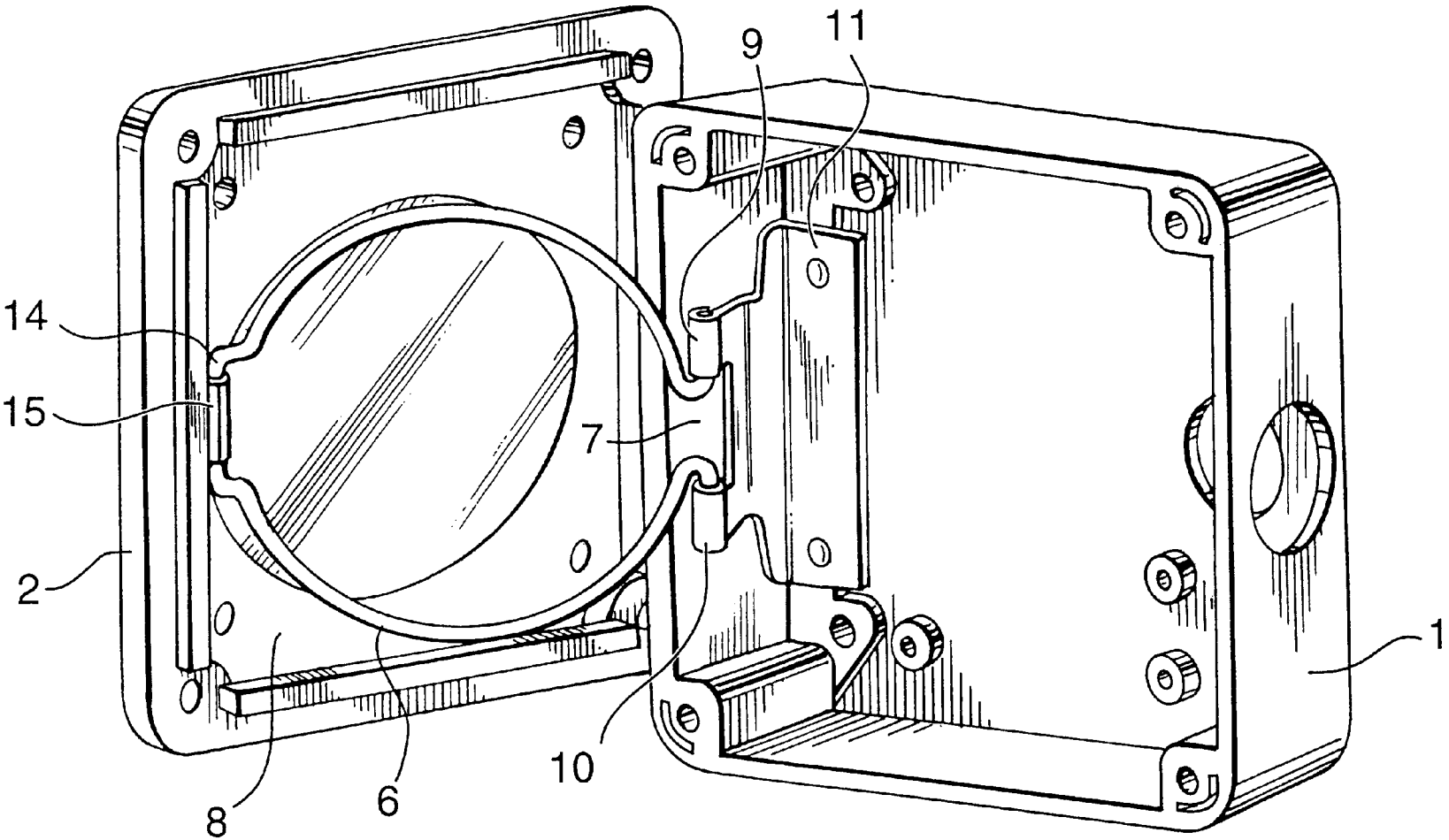
FIG. 2*a* is a perspective view of a first preferred embodiment of the apparatus showing the cover open.

FIG. 2*a* depicts schematically the architecture of a first preferred embodiment of the invention. In addition to the parts described in FIG. 1*a,* the apparatus of FIG. 2*a* includes a wire hinge 6, a hinge bracket 7 and a cover bracket 15. The wire hinge 6 consists of a piece of wire of sufficient tensile strength to allow it to be formed so as to conform to the shape and size of the interior dimensions of the main body 1 of the protective enclosure 16 and to act as a compression spring. The wire hinge 6 is shaped in such a manner that it does not interfere with the placement and/or closure of the cover 2 onto the main body 1 of the protective enclosure 16, and so that it does not interfere with any other camera components within the protective enclosure 16. Furthermore, the tensile strength of the wire must also be sufficient to enable the wire to bear the weight of the cover, and any associated camera components attached to or held within the cover, without bending, breaking or otherwise distorting when the cover is placed in an open position.

The wire hinge 6 of FIG. 2*a* has a round-like shape so as to accommodate the shape of the lens cover 4 of the camera and so as not to interfere with the camer's field of view through the lens cover 4. The wire should have sufficient tensile strength to enable it to be shaped to form an open-ended compression spring with insertion-pieces, and to bear the weight of the cover 2, and any associated camera components within the cover, without bending, breaking, or distortion when the cover 2 is removed and placed in an open position. The ends of the wire hinge 6 bend back sharply on themselves to form a first insertion-piece 12 and a second insertion-piece 13 to form an open-ended spring for insertion into the hinge bracket 7. The wire to further shaped to form a third insertion-piece 14 for insertion into the cover bracket 15. The first insertion-piece 12, second insertion-piece 13 and third insertion-piece 14 and their respective shapes are more clearly shown in FIG. 2*b*.

When the open-ended wire hinge 6 is compressed, the first insertion-piece 12 and the second insertion-piece 13 fit, respectively, into the first hinge element 9 and second hinge element 10 of the hinge bracket 7, as shown in FIG. 2*a*. The third hinge element 14 of the wire hinge 6, more clearly seen in FIG. 2*b,* is formed to fit under the cover bracket 15 also shown in FIG. 2*b*. The cover bracket 15 is formed to attach to or be an integral part of the cover 2. It is designed with one open side under which the third hinge element 14 may be inserted. The cover bracket 15 is designed to hold the third hinge element 14 via compression. The compression actor of the cover bracket 15 is such that it is sufficient to hold the third hinge element 14 in place when inserted, but without restricting the movement of the third hinge element 14 within the cover bracket 15. A particular advantage of the hinge element 14 is that the direction in which the cover 2 opens is not fixed by the hinge element 14. Rather, the hinge element 14 provides a means of attaching the cover 2 to main body 1 of the protective enclosure 16 and will accommodate opening and closing in whatever orientation or direction is suitable for the style of protective enclosure 16 to which it is fitted.

Figure 3A:
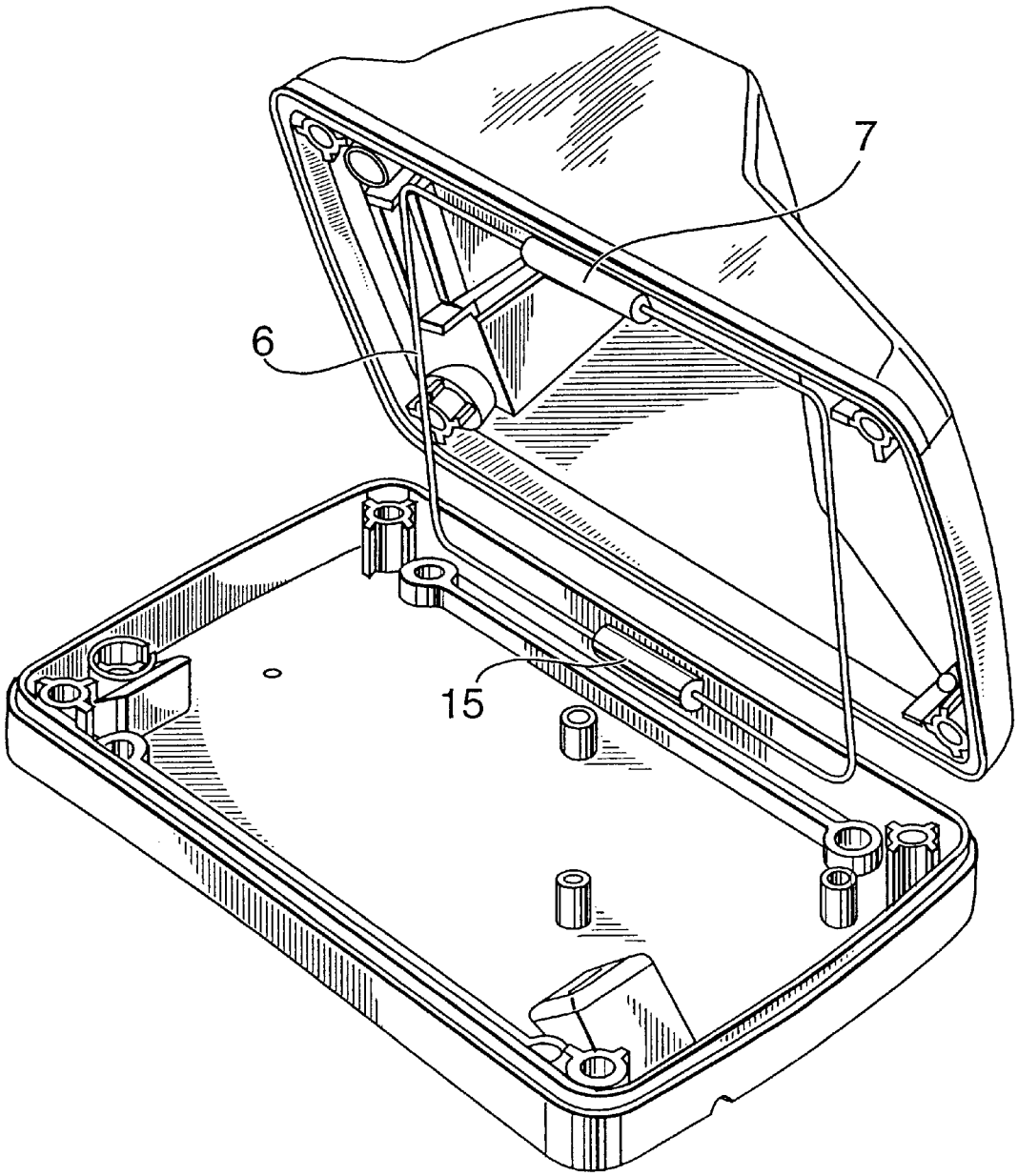
FIG. 3*a,* 3*b,* 3*c* and 3*d* are alternative embodiments of the invention disclosed herein for various types of protective closures commonly found in video surveillance installations.
Figure 3B:
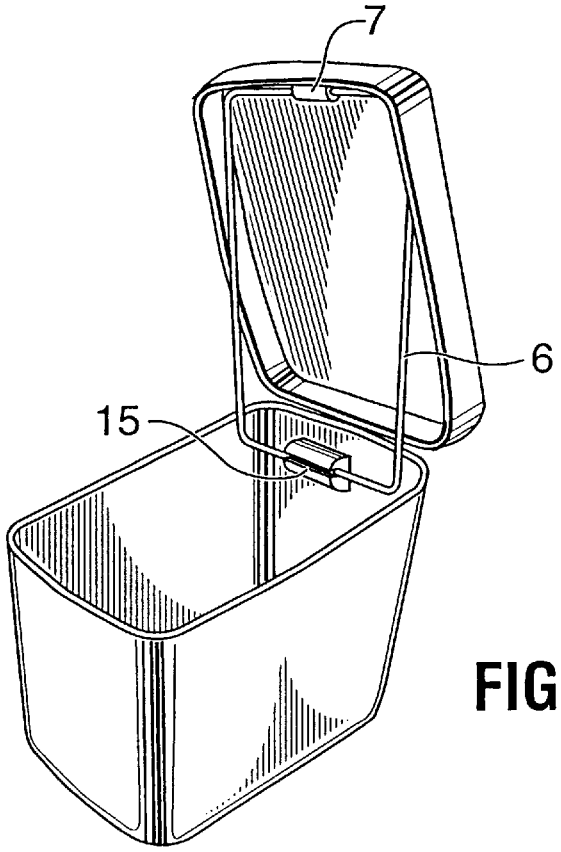
Figure 3C:
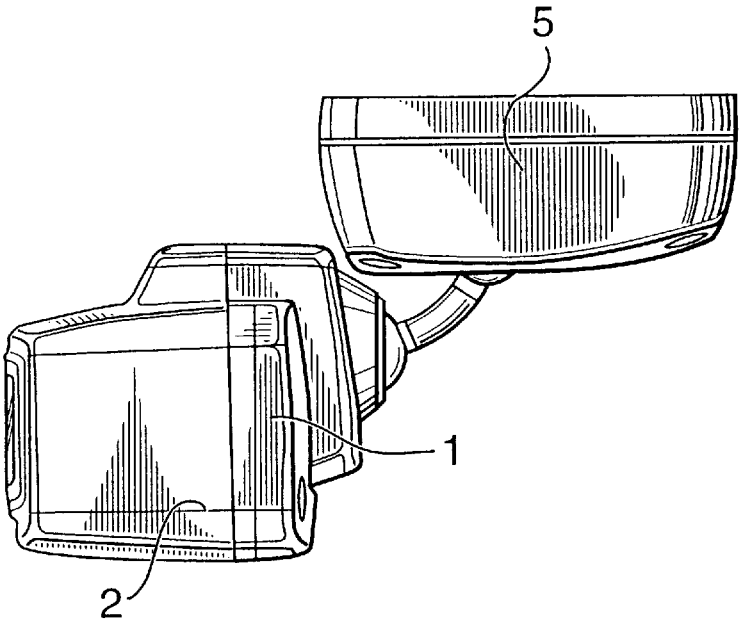
Figure 3D:
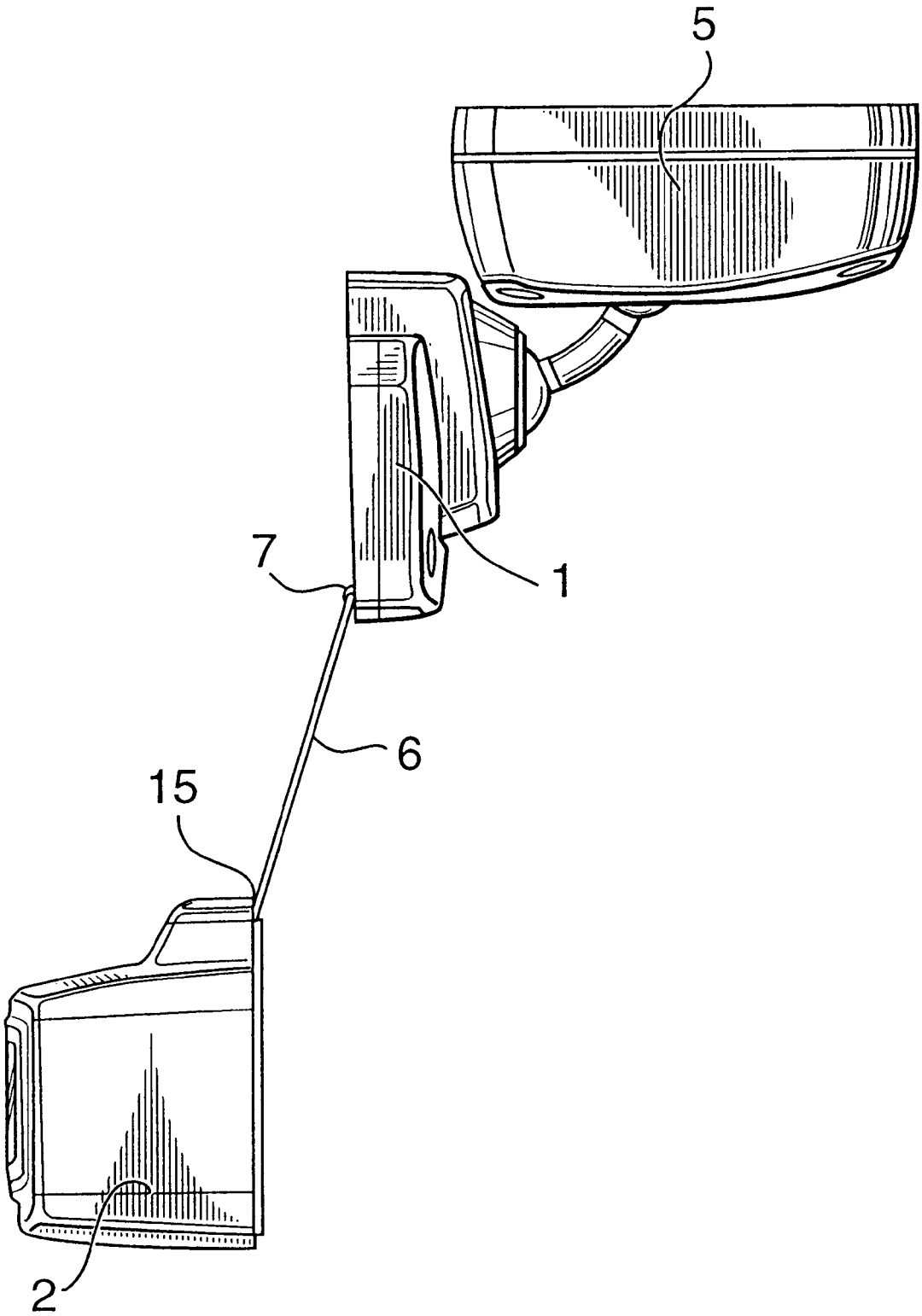

FIG. 3*c* and FIG. 3*d* together provide an example of a self-enclosed video surveillance camera. FIG. 3*c* depicts schematically a side view of the self-enclosed video surveillance camera unit, with the cover 2 in closed position and attached to the main body 1. FIG. 3*d* depicts schematically the same unit showing the cover 2 in an open position exhibiting the wire hinge 6, hinge bracket 7, and cover bracket 15. The embodiment of FIG. 3*d* provides the advantages of permitting the cover 2 to be removed from the main body 1 of the protective enclosure 16 while retaining an attachment to the enclosure and, at the same time, permitting un-restricted access to the video camera components housed within the protective enclosure 16. Unrestricted access means that a maintenance worker can access the protective enclosure 16 from any angle. This un-restricted access permits the camera within the protective enclosure 16 to be adjusted at any angle desired without the cover 2 interfering with the field of view. Once the tamper-proof screws are removed, the cover 2 need only be gently moved from the main body 1 into a position indicated by the extreme open position of the wire hinge 6. As a result, a workman removing the cover 2 no longer needs to try to catch the cover 2 before it falls to the ground, and avoids a potentially dangerous situation when performing installations or maintenance of video surveillance camera units.

Several variations of the embodiments disclosed above are apparent. Firstly, the wire hinge 6 may have a variety of shapes so as to conform to the shape, interior dimensions, and placement of other associated camera components within the protective enclosure 16, including, for example, having a round, square, oval, or rectangular shape. FIG. 2*a,* 2*b* and 2*c* show the wire hinge 6 having a round shape. This shape was found to be preferable for a protective enclosure 16 fitted with a dome lens cover 4. FIG. 3*a* and FIG. 3*b* provide a second and third alternative embodiment of the wire hinge 6 having a rectangular shape suitable for both the wedge-shaped and rectangular-shaped protective enclosures 16.

Figure 2B:
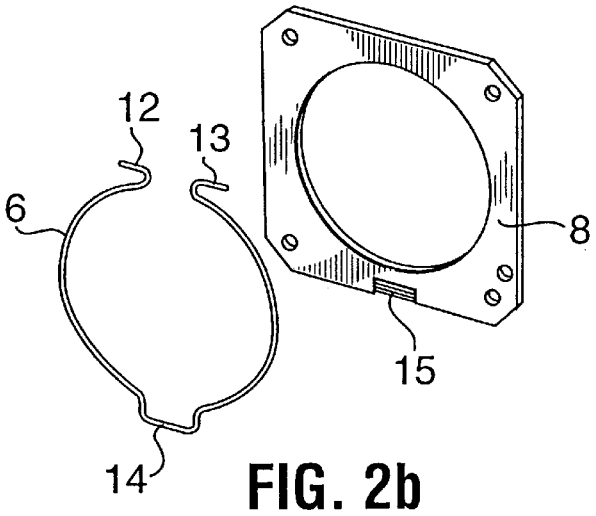
FIG. 2*b,* 2*c* and 2*d* are schematic views of the various components of the first preferred embodiment of the invention disclosed herein.
Figure 2C:
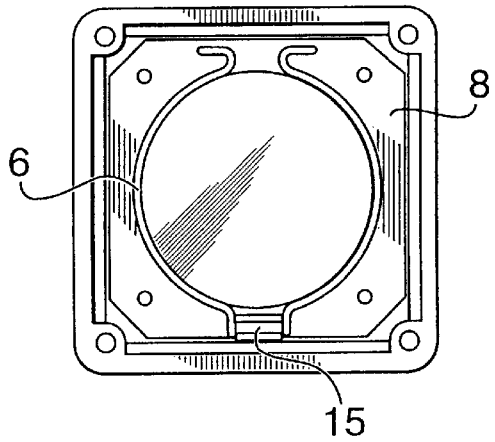
Figure 2D:
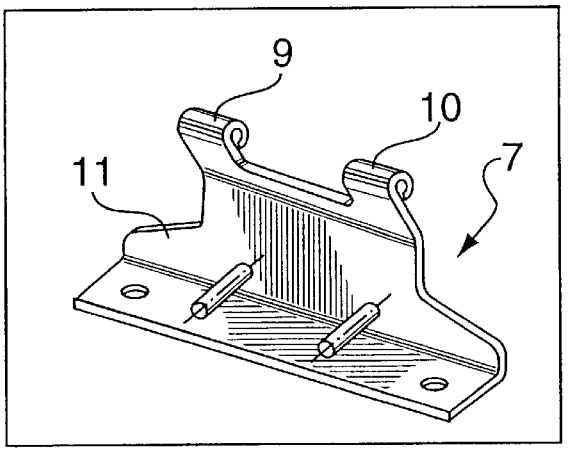

Second, the hinge bracket 7 may have several alternate embodiments including, but not limited to, the hinge bracket 7 as shown in FIG. 2*a* and, alternatively, as shown in FIG. 3*a* and FIG. 3*b*. The hinge bracket 7 shown in FIG. 2*a* is designed to attach as a separate component to a protective enclosure 16. FIG. 2*d* provides a more detailed view of the same hinge bracket. This type of hinge bracket is not formed as an integral part of the main body 1 but, rather, it is formed as a separate component, which is attached via an attachment means 11 to the protective enclosure 16. FIG. 2*a* shows diagrammatically how this particular embodiment of the hinge bracket 7 is envisioned, attaching to square-shaped protective enclosure 16 for a cover 2 having a dome lens. FIG. 3*a* and 3*b* show diagrammatically an alternate embodiment of the hinge bracket 7 which is formed as an integral part of the protective enclosure 16.

Thirdly, the cover bracket also has multiple alternative embodiments including, but not limited to, those shown with reference to FIGS. 2*a,* 2*b,* 2*c* and FIGS. 3*a,* 3*b,* and 3*c*. The cover bracket 15 shown in FIG. 2*a* is designed to attach as a separate component to the cover 2 of the protective enclosure 16. FIG. 2*b* provides a more detailed view of the cover bracket 15 as it is formed as part of an adjacent component assembly 8. Of particular note is that this type of cover bracket 15 is not formed as an integral part of cover 2, rather it is formed as a separate assembly component 8 which is attached separately to the cover 2. In this case, the separate component 8 serves as a retainer plate to hold the dome lens 4 against the cover 2. Simple efficiency of mechanical design allows the cover bracket 15 to also be formed from the separate assembly component 8. FIG. 2*b* shows diagrammatically the separate assembly component 8, and FIG. 2*c* shows how this particular embodiment of the cover bracket 15 is envisioned attaching to square-shaped cover having a dome lens. FIG. 3*a* and FIG. 3*b* show diagrammatically an alternate embodiment of the cover bracket 15 which is formed as an integral part of the protective enclosure 16.

Thus an apparatus and its variations described herein provide a means for permitting the easy removal of a cover without its complete disengagement from the protective enclosure of a video surveillance camera while maintaining the attachment of the cover to the main body of the protective enclosure without hindering access to the internal components within the enclosure. The advantages the invention and its variations disclosed herein for applications of similar type beyond use with video surveillance cameras are also envisioned, although not presently mentioned.

What is claimed is:

1. A protective enclosure for a video surveillance camera, comprising:

(a) a body with an interior cavity;

(b) a cover removably affixable to said body;

(c) a hinge bracket affixed to said body at one end of said body;

(d) a cover bracket affixed to said cover at one end of said cover located opposite said one end of said body when said cover is affixed to said body;

(e) a hinge operative to connect said cover to said body, wherein said hinge is attached at one end to said hinge bracket and at another end to said cover bracket;

wherein said cover can be pivotally removed and extended away from said body such that the interior cavity of said body is completely exposed and a user is provided access to said interior cavity from any angle, thereby allowing a camera mounted within said interior cavity to be panned and adjusted through any angle without said cover interfering with a field-of-view of said camera.

2. The protective enclosure of claim 1, wherein said hinge consists of a length of wire which conforms to the shape and size of the interior perimeter of said body so that said hinge does not interfere with the placement and closing of said cover onto said body, not with any components within said body.

3. The protective enclosure of claim 2, wherein said wire has sufficient tensile strength to form an open-ended spring having open ends bent back sharply on themselves wherein said open ends can be pressed together and inserted into said hinge bracket and constrained thereby to pivotal movement.

4. The protective enclosure of claim 3, wherein the tensile strength of said wire is high enough such that said hinge is capable of bearing the weight of said cover and components attached to or held within said cover without fracture or distortion of said wire.

5. The protective enclosure of claim 2, wherein said wire has a cover bracket insertion portion compressible so as to be insertable into said cover bracket.

6. The protective enclosure according to claim 1, wherein said hinge bracket is affixed to said body and further includes a first hinge element and a second hinge element operative to receive respective ends of said hinge and to hold said ends in compression.

7. The protective enclosure according to claim 6, wherein said cover bracket has an open side into which a third hinge element on a side of said hinge opposite said ends is slidably insertable, said third hinge element being held in said cover bracket by compression, thereby providing an attachment of said cover to said body.

* * * * *